US005337441A

United States Patent [19]

Miyamoto et al.

[11] Patent Number: 5,337,441

[45] Date of Patent: Aug. 16, 1994

[54] EXTRACTION/INSERTION TYPE SOOT BLOWING APPARATUS

[75] Inventors: Masaaki Miyamoto; Yoshinori Yuzaki; Kunihisa Fujihara, all of Hiroshima, Japan

[73] Assignee: Mitsubishi Jukogyo Kabushiki Kaisha, Tokyo, Japan

[21] Appl. No.: 15,801

[22] Filed: Feb. 10, 1993

[51] Int. Cl.[5] ..... A47L 5/38; A47L 15/00

[52] U.S. Cl. ..... 15/318.1; 15/317; 122/382; 122/390; 122/392; 134/167 C

[58] Field of Search ..... 122/379, 390, 391, 392, 122/382; 15/316.1, 317, 318, 318.1; 134/167 C

[56] References Cited

U.S. PATENT DOCUMENTS 4,354,294 10/1982 Silver ..... 15/317
4,803,959 2/1989 Sherrick et al. ..... 122/379
5,065,472 11/1991 Carpenter et al. ..... 15/317

*Primary Examiner*—Edward G. Favors

*Attorney, Agent, or Firm*—Wenderoth, Lind & Ponack

[57] ABSTRACT

The present invention relates to an extraction/insertion type soot blowing apparatus in which a lance tube is inserted into a combustion chamber, and a high-pressure gas is blown from a nozzle provided at the tip end of the lance tube against a deposit adhered onto the inner surface of the combustion chamber to remove the deposit. A rack adapted to be advanced and withdrawn along with the lance tube, and a long shaft for rotating the lance tube, are driven due to connection thereof with two output shafts of a differential gear device, and rotation and linear motion of the lance tube are respectively restrained within predetermined ranges. Thereby, at first the lance tube is inserted into the combustion chamber at a high speed without being rotated, and thereafter the advance is stopped and a gas is discharged while the lance tube is being rotated. Accordingly, the time period in which the tip end portion of the lance tube is exposed to a high temperature is short, such that the lance tube does not become overheated.

4 Claims, 4 Drawing Sheets

EXTRACTION/INSERTION TYPE SOOT BLOWING APPARATUS

BACKGROUND OF THE INVENTION

1. Field of the Invention

The present invention relates to improvements in an extraction/insertion type soot blowing apparatus.

2. Description of the Prior Art

An extraction/insertion type soot blowing apparatus is an apparatus which is inserted into a combustion chamber of a heat-exchanger or the like to blow air or steam at a high pressure against a deposit (23) adhering to a heat-absorbing portion (24) (water-wall tubes or the like) contiguous to wall surface (22) to remove the deposit, as shown in FIG. 6. This promotes heat absorption by the heat-absorbing portion (24) and improves efficiency of heat recovery.

One example of an extraction/insertion type soot blowing apparatus in the prior art is shown in FIG. 6. Reference numeral (013) designates a head valve, and feed and interruption of injection medium (air, steam, or the like) is carried out by this head valve (013). An injection (or discharge) medium is discharged from a nozzle provided at a tip end of a lance tube (015) through a feed pipe (014). The lance tube (015) simultaneously rotates and moves in the axial direction, while discharging medium against a deposit (23), in order to remove the deposit (23) adhering to the surface of the heat-absorbing portion (24).

Driving of the above-described lance tube (015) is effected in the following manner. That is, rotation of a power source (01) is reduced in speed by a gear box (02), and a lead screw (06) is rotated via gears (03), (04) and (05). The lead screw (06) moves a gear box (08) in its axial direction. Within the same gear box (08), the lance tube (015) and a gear (012) are directly connected with each other, and the lance tube (015) moves in the axial direction as interlocked with the gear box (08). On the other hand, rotation of the lance tube (015) is effected by rotating the gear (012) via a long key slot provided along the entire length of the lead screw (06), a key (not shown) and a gear (011).

In addition, starting and stopping of the flow of the injection medium is carried out by the head valve (013) as described above, and opening and closing of the same valve (013) is effected by actuating a valve opening/-closing cam (017) by means of a dog (016) provided on the gear box (08) when the gear box (08) moves in the axial direction, and valve moving levers (019) and (020) via a connecting rod (018). More particularly, provision is made such that when the dog (016) on the gear box (08) has reached a point P, discharge is commenced, and when it continues to move further (advance) in the axial direction and has reached a point Q, the power source (01) reverses and the gear box (08) moves in the direction of retreat. When the gear box (08) has reached the point P again, the discharge terminates. Thus, discharge of the medium occurs over the range from a point R to a point S, as depicted in FIG. 6.

The above-described prior art extraction/insertion type soot blowing apparatus has the following shortcomings:

1) Since the lance tube (015) advances and retreats in the axial direction by rotating and while discharging the discharge medium, the soot removing power (momentum) is not stable over the range of from the point R to the point S. More particularly, as the discharge nozzle of the lance tube (015) moves between the point R and the point S, the distance between the nozzle and the heat-absorbing surface to be cleaned varies, and further a circumferential velocity of the discharge medium at the surface to be cleaned also varies. Consequently, the soot removing effects are non-uniform.

2) The lance tube (015) rotates several revolutions while moving over the range from the point R to the point S. Therefore, a discharge angle cannot be limited, and hence, even if it should become necessary to avoid injection at a corner portion of a combustion chamber or the like, it cannot be done.

3) The time it takes for the lance tube (015) to move from the point T to the point R is long, and so, the tip end portion of the lance tube (015) becomes overheated when exposed to a high-temperature gas before it reaches the point R. Also, since the discharge medium flows into the tip end portion when it has reached the point R, the tip end portion of the lance tube (015) is quickly cooled and thus is subjected to a thermal shock, so as to sometimes cause damage to the nozzle.

4) Due to the fact that the moving range (from the point T up to the point S) of the lance tube (015) is long, the entire apparatus is long and requires a large installation space.

5) In addition to the poor soot removing performance as described in paragraph 1) above, the discharge time is long and a large amount of the discharge medium is consumed.

6) In relation to the disadvantage described in paragraph 2) above, since the discharge medium is discharged at a high temperature toward the heat-absorbing portion (the water-wall tubes) at a predetermined angle, sometimes even after removal of the soot, the heat-absorbing portion (the water-wall tubes) are liable to be thermally damaged.

SUMMARY Of THE INVENTION

It is therefore one object of the present invention to provide a soot blowing apparatus which is free from the above-described shortcomings of the prior art soot-blowing apparatus.

A more specific object of the present invention is to provide an improved soot blowing apparatus in which a lance tube can be advanced up to a discharge position at a high speed and also can be withdrawn to its original start position at a high speed.

Another object of the present invention is to provide an improved soot blowing apparatus, in which a discharge medium is discharged onto a surface from which a deposit is to be removed in a direction nearly in parallel with the surface, such that the deposit removing power is made uniform and the fear of damaging the surface is eliminated.

Still another object of the present invention is to provide an improved soot blowing apparatus, in which the functions of advancing and withdrawing the lance tube are independent of the function of rotating the lance tube for discharging the discharge medium, to thereby make it possible to perform the advancing and withdrawal functions of the lance tube at a high speed and also perform high-speed rotation of the lance tube at a fixed position for discharging the medium.

According to one feature of the present invention, there is provided an extraction/insertion type soot blowing apparatus comprising a lance tube having at its tip end an injection nozzle directed nearly at right angles the longitudinal axis of the lance tube, a rack disposed in parallel to the lance tube and engaged with a pinion, a support plate fixedly secured to the rack for supporting the above-mentioned lance tube rotatably while axial movement thereof is restrained, a long shaft disposed in parallel to the above-mentioned lance tube and supported by the aforementioned support plate in a freely rotatable and freely axially movable manner, a differential gear device having its input shaft connected to a rotary drive source, one of its output shafts connected to the above-described pinion and the other output shaft connected to the aforementioned long shaft, means for transmitting rotation of the aforementioned long shaft to the above-described lance tube, means for restraining rotation of the aforementioned long shaft when the above-mentioned lance tube is present behind a predetermined position, means for preventing the aforementioned lance tube from moving in front of the above-mentioned predetermined position, and means for feeding a discharge medium into the above-described lance tube when the lance tube is present at the above-mentioned predetermined position.

In the extraction/insertion type soot blowing apparatus according to the present invention, owing to the above-mentioned structural features, the lance tube is advanced, along with the rack, at high speed and without being rotated to a proximity of a combustion chamber wall surface where it stops. At this position, the lance tube can discharge a discharge medium in parallel against a heat-absorbing portion (water-wall tubes) while being rotated in accordance with rotation of a long shaft. Accordingly, the tip end portion of the lance tube will not be over-heated because the time period in which the tip end portion is exposed to high-temperature gas is short. Also, because of the parallel discharge, there is no fear that the water-wall surface will be damaged, the soot-removing power is made uniform, and an efficient soot-removing effect can be obtained.

The above-mentioned and other objects, features and advantages of the present invention will become more apparent by reference to the following description of a preferred embodiment of the present invention taken in conjunction with the accompanying drawings.

DESCRIPTION OF THE PREFERRED EMBODIMENT

Figure 1:
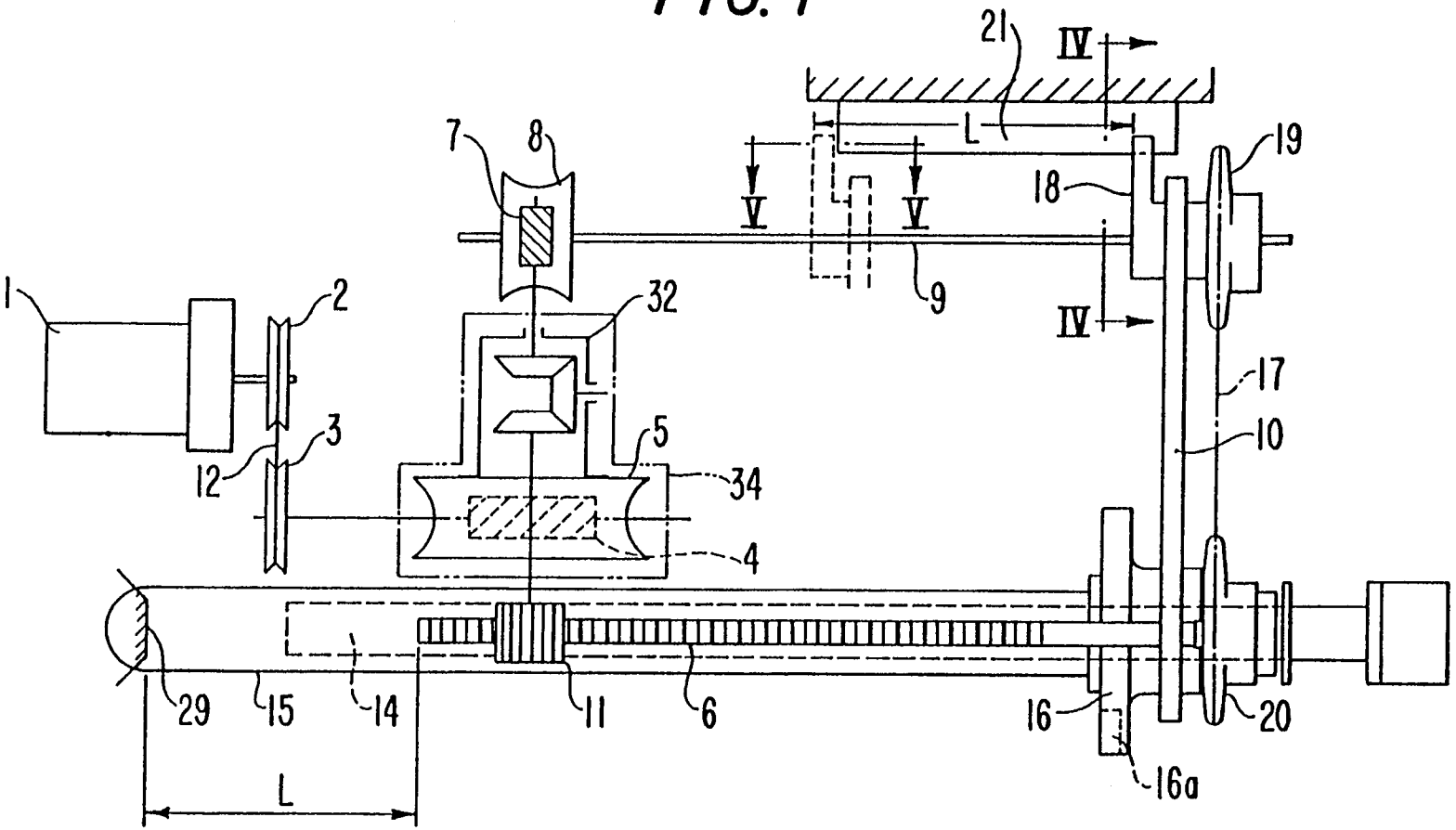
FIG. 1 is a plan view showing an extraction/insertion type soot blowing apparatus according to one preferred embodiment of the present invention.
Figure 2:
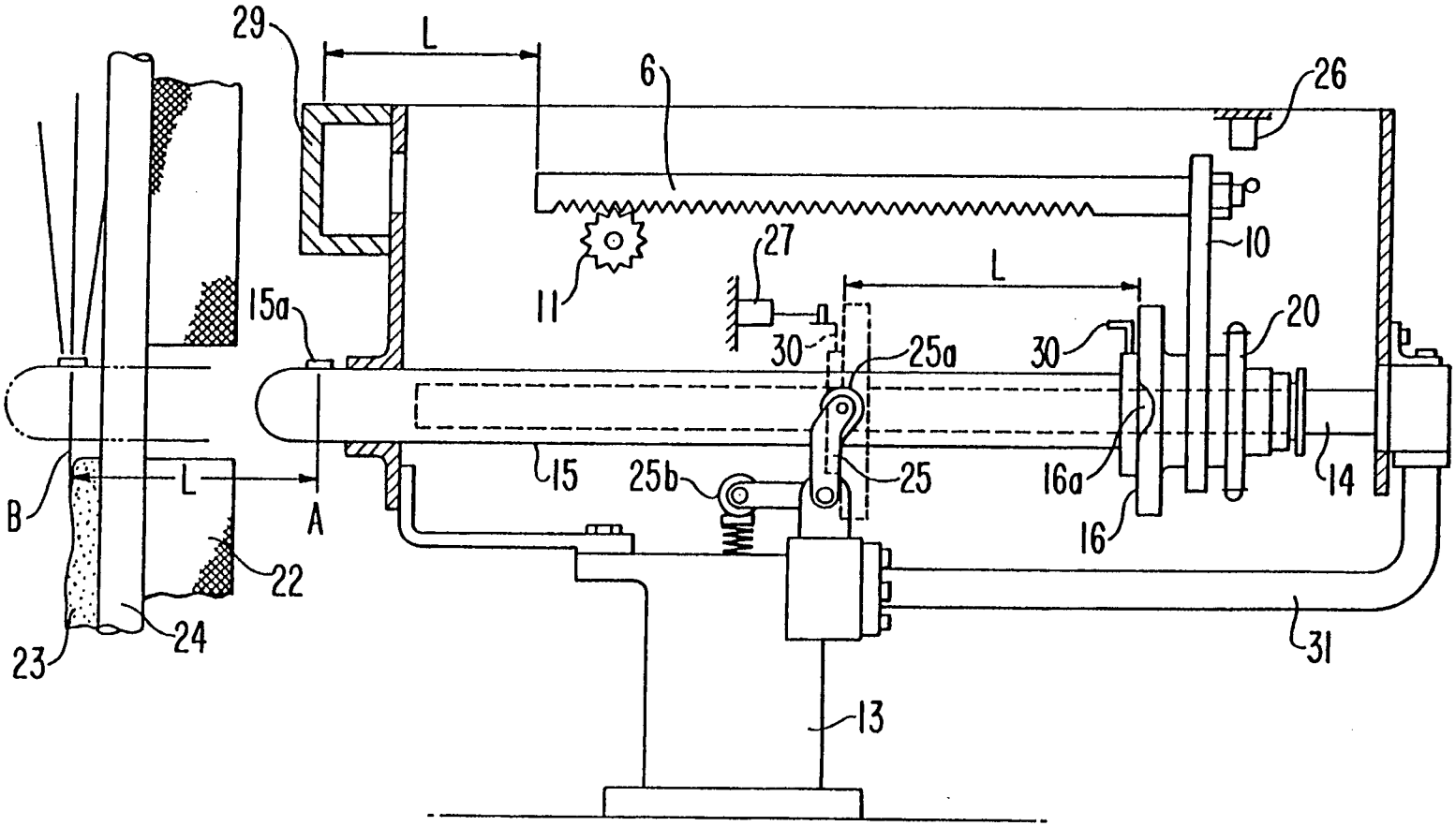
FIG. 2 is a side view showing the same extraction/insertion type soot blowing apparatus.
Figure 3:
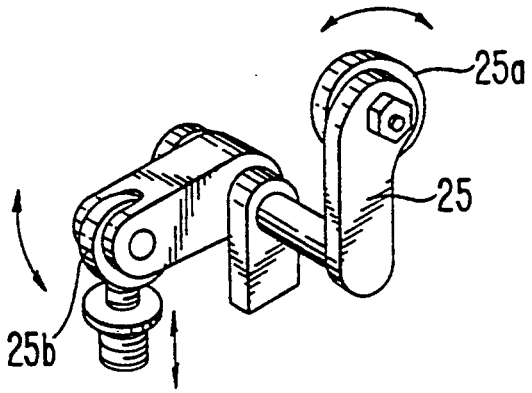
FIG. 3 is a perspective view showing a linkage (25) in FIG. 2) on an enlarged scale.

An improved extraction/insertion type soot blowing apparatus according to one preferred embodiment of the present invention is illustrated in FIGS. 1 to 5.

In these figures, reference numeral (15) designates a lance tube, and numeral (6) designates a rack disposed in parallel to the lance tube. To this rack (6) is fixedly secured a support plate (10), and the above-mentioned lance tube is rotatably supported from the support plate (10). An opening/closing cam (16) and a sprocket (20) are fixed to the lance tube (15) with the support plate (10) placed therebetween. A pinion (11) is meshed with the above-mentioned rack (6), and as a result of rotation of a gear motor (1) serving as a drive source, this pinion (11) is rotated via a pulley (2), a V-belt (12), a pulley (3), a worm (5), and differential gears (32). When the pinion (11) is rotated, the rack (6) and the lance tube (15) undergo linear motion in the lengthwise direction.

A feed pipe (14) loosely fits into the lance tube (15), so that a discharge medium (air, steam, etc.) at a high temperature and at a high pressure may be fed through a head valve (13) and a steam pipe (31) and discharged through a nozzle (**15*a*) which opens through the tip end portion of the lance tube (15**) and is directed perpendicular to the axis of the lance tube.

Figure 4:
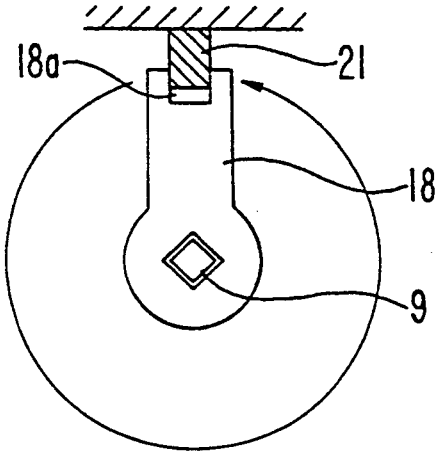
FIG. 4 is a cross-sectional view taken along line IV—IV in FIG. 1 showing engagement between a moving plate and a guide.

The other output shaft of the above-mentioned differential gears (32) is connected to a worm (7) and a worm gear (8) to transmit rotation to a long shaft (a square shaft) (9) having its one end fitted into this worm gear (8), and thus it is used for the purpose of rotating the lance tube (15). In FIG. 1, the component parts encircled by a double-dot chain line constitute a differential gear device (34). The other end portion of the square shaft (9) is rotatably supported by the above-mentioned support plate (10), and also has a sprocket (19) mounted thereon. Between this sprocket (19) and the above-mentioned sprocket (20) is stretched a chain (17). The above-mentioned support plate (10) and sprocket (19) are both freely movable in the lengthwise direction with respect to the square shaft (9). At the end portion of the square shaft (9) is also mounted a moving plate (18) so as to be movable integrally with the support plate (10), and a tip end of the moving plate (18) is engaged with a guide (21) in a laterally movable manner as shown in FIG. 4.

The opening/closing cam (16) is fixedly secured to a base portion of the lance tube (15) and is provided with a notch (**16*a*). The head valve (13) is equipped a linkage (25), and provision is made such that as a result of movement in the axial direction of the lance tube (15), the notch (16*a*) of the opening/closing cam (16) may be engaged with a cam follower (25*a*) of the linkage (25), and thereafter the head valve (13) may be opened and closed by rotation of the lance tube (15**) to cause or interrupt discharge of the discharge medium.

A stopper (29) is a member for restraining an advancing position of the rack (6) (that is, of the lance tube (15)), and when the lance tube (15) has advanced by a predetermined stroke L, the tip end of the rack (6) strikes against the stopper (29) to thereby prevent advancing motion. Provision is also made such that, just at this position, the notch (**16*a*) of the above-mentioned opening/closing cam (16) and the cam-follower (25*a*) of the linkage (25**) may be engaged with each other.

The following is a description of an operation (soot blowing operation) of the soot blowing apparatus having the above-mentioned construction. Before starting, the nozzle (**15*a*) of the lance tube (15) is present at the starting position A (see FIG. 2) outside of a combustion chamber, and the head valve (13) is kept closed. The moving plate (18) is fitted to the guide (21**), and its rotation is kept constrained.

When the gear motor (1) is driven in response to a start command, its rotation is transmitted to the pinion (11) via the worm (4), the worm gear (5) and the differential gears (32) as described above, such that the pinion (11) is driven, and also the rotation of the gear motor (1) drives the worm gear (8) via the differential gears (32) and the worm (7) and tends to rotate the square shaft (9). However, at this time, since a slot (18*a*) of the moving plate (18) fitted around the square shaft (9) is engaged with the guide (21) as shown in FIG. 4, rotation of the square shaft (9) is restrained. Accordingly, as a result of a characteristic property of the differential gears (33), rotation of the output shaft on the side of the pinion (11) is accelerated to a speed twice as large as a predetermined speed, and hence the lance tube (15) advances at a high speed along with the rack (6). At this time, the members on the side of the square shaft (9) (the moving plate (18) and the sprocket (19)) move in an interlocked manner with the lance tube (15) via the support plate (10) without being rotated.

When the lance tube (15) has advanced by a predetermined stroke L and the nozzle (15*a*) has reached a predetermined (operating) position B within a combustion chamber, the tip end of the rack (6) strikes against the stopper (29) and its further advance is prevented. Just at that time, the moving plate (18) is present at such position that its engagement with the guide (21) is released as shown by a dash line in FIG. 1, and accordingly, the square shaft (9) is released from restraint and becomes rotatable. However, since the output shaft on the side of the pinion (11) is restrained from rotating due to the fact that advance of the rack (6) is prevented by the stopper (29), now the output shaft on the side of the worm (7) is accelerated to a speed twice as large as a predetermined speed and rotates the square shaft (9). This rotation of the square shaft (9) is transmitted to the lance tube (15) via the chain drive mechanism (19), (17) and (20), and the lance tube (15) is rotated.

On the other hand, as described previously, when the lance tube (15) has advanced by a stroke L, the notch (16*a*) of the opening/closing cam (16) is engaged with the cam-follower (25*a*) of the linkage (25). When the lance tube (15) rotates under this condition, the cam-follower (25*a*) is pushed out of the notch (16*a*), hence the entire linkage (25) moves in the counterclockwise direction in FIG. 2, and as a result of the fact that the other cam-follower (25*b*) operates to open an opening/closing mechanism of the head valve (13), a discharge medium is fed through the steam pipe (31) to the feed pipe (14). During the period when the lance tube (15) performs one revolution, the discharge medium fed to the feed pipe (14) is discharged from the nozzle (15*a*) to remove a deposit (23) adhered to the surface of the water-wall tubes (24). The injection is effected against the surface of the water-wall tubes (24) nearly in parallel with the surface while the lance tube (15) makes one revolution.

When the lance tube (15) has finished one revolution, a dog (30) provided on the opening/closing cam (16) actuates a reversing limit switch (27) to drive the gear motor (1) in reverse. At the same time, the engagement between the opening/closing cam (16) and the linkages is released and the head valve (13) is closed, hence feeding of the discharge medium to the lance tube (15) is interrupted and discharge thereof is stopped. At the same time, as a result of the fact that the slot (18*a*) of the moving plate (18) is again engaged with the guide (21), rotation of the square shaft (9) is restrained and stops, and rotation of the lance tube (15) connected via a chain drive mechanism also stops. Thereafter, the lance tube (15) is withdrawn at a high speed by the rotation of the pinion (11) and movement of the rack (6), and when the lance tube (15) has moved by the stroke L and the nozzle (15*a*) has returned again to the position A, a stopping limit switch (26) is actuated, hence the lance tube (15) stops and one cycle of the soot blowing operation is completed.

Figure 5:
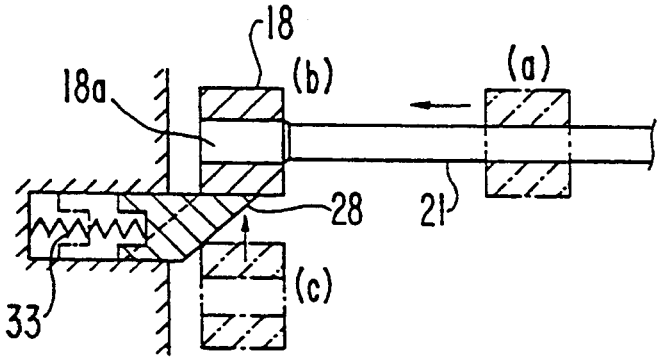
FIG. 5 is a cross-sectional view taken along line V—V in FIG. 1 showing a fitting assistant mechanism between a moving plate and a guide.
Figure 6:
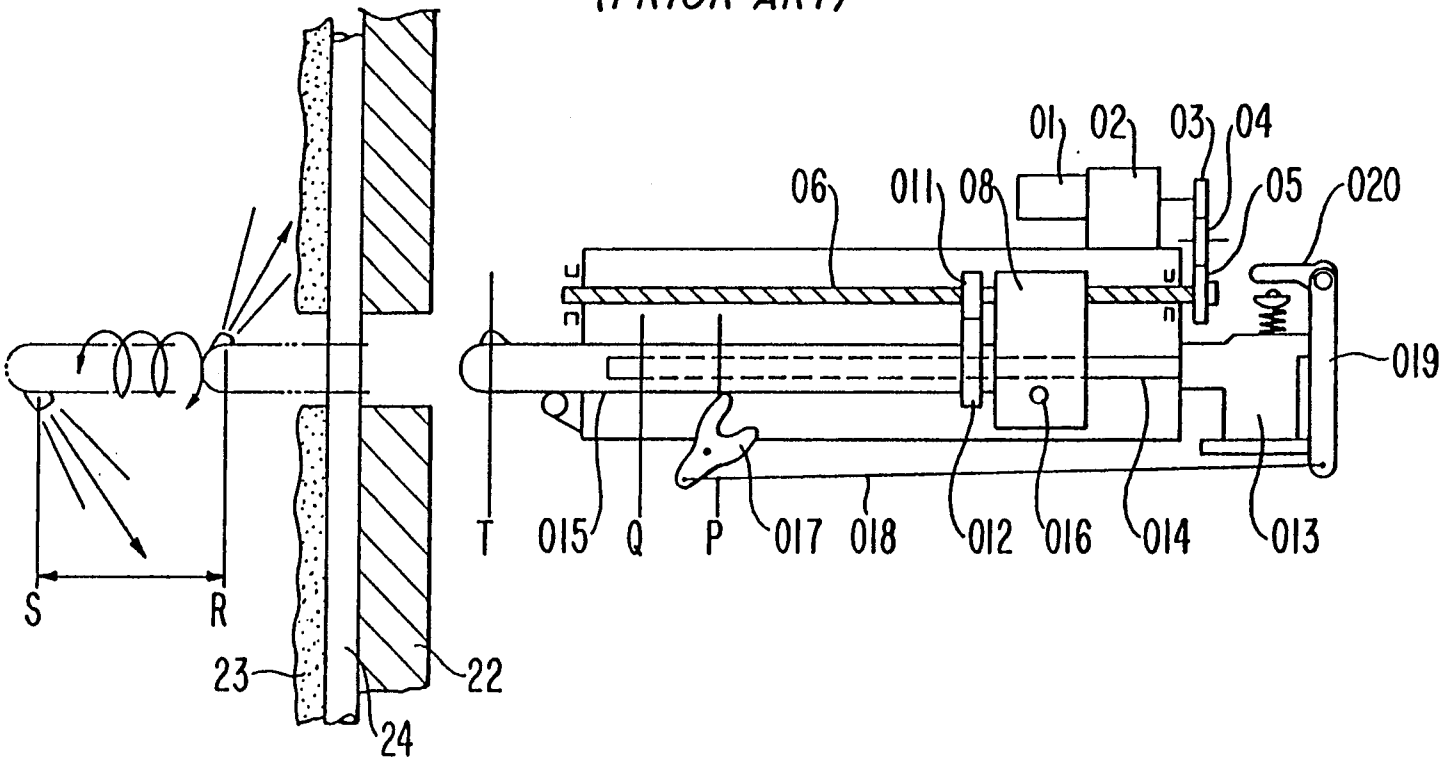
FIG. 6 (PRIOR ART)
FIG. 6 is a schematic cross-sectional view showing one example of a prior art extraction/insertion type soot blowing apparatus.

In the above-described operation, while the gear motor (1) is reversed in rotation when the lance tube (15) has made one revolution, discharge has been completed and the reversing limit switch (27) has been actuated, in the event that at this time the slot (18*a*) of the moving plate (18) should not be held fitted to the guide (21), only the square shaft (9) will rotate along with the moving plate (18) (the members on the side of the pinion (11) cannot be driven in reverse because they are subjected to a far larger resistance as compared to the members on the side of the worm gear device due to a reaction force between the rack (6) and the stopper (29)) and sometimes it will result in an accident. Therefore, for the purpose of ensuring the fit between the moving plate (18) and the guide (21), an assistant mechanism as shown in FIG. 5 is used. When the moving plate (18) fitted to the guide (21) has moved by a stroke L from a position (a) to a position (b) in FIG. 5, as shown by solid lines, the fitting between the moving plate (18) and the guide (21) is released, and the moving plate (18) is held in contact with a movable piece (28). The movable piece (28) is subjected to a force directed toward the right as viewed in FIG. 5 by means of a spring (33). Assuming now that the fitting is released at the solid line position (b), the moving plate (18) will be rotated forwardly as interlocked with the lance tube (15) by the square shaft (9), and at a chain line position (c) it comes into contact with the movable piece (28) and pushes the same movable piece (28) into a position depicted by a dash line. When the moving plate (18) has come to the position (b), the movable piece (28) released from contact with the moving plate (18) is restored to the solid line position by the spring (33). During this period, the lance tube (15) makes one revolution, and since the dog (30) actuates the reversing limit switch (27) and reverses the gear motor (1), the slot (18*a*) of the moving plate (18) prevented from rotating in reverse by the movable piece (28), will be surely fitted to the guide (21).

As will be obvious from the detailed description of the construction and operation of one preferred embodiment of the present invention, in the extraction/insertion type soot blowing apparatus according to the present invention, the lance tube can be advanced at a high speed up to a predetermined discharge position, and also can be withdrawn at a high speed from the discharge position to the start position. Accordingly, the overall time required for blowing the deposited soot is reduced. Also, since the period when the tip end portion of the lance tube is exposed to a high-temperature gas is shortened, there is no fear that the tip end portion will be overheated. In addition, owing to the fact that the nozzle is stopped in the proximity of the wall surface of the combustion chamber and the discharge medium is discharged against a heat-absorbing portion (water-wall tubes) nearly in parallel therewith, there is no fear of damaging the water-wall tube surfaces. Furthermore, since injection is effected at a fixed position, the soot removing power can be made uniform, and thereby a highly efficient soot-removing effect can be realized.

While a principle of the present invention has been described above in connection with one preferred embodiment of the invention, it is a matter of course that many apparently widely different embodiments of the present invention can be made without departing from the spirit of the present invention.

What is claimed is:

1. An extraction/insertion type soot blowing apparatus, comprising:

a support structure;

a lance tube mounted to said support structure, having a longitudinal axis, and being axially movable relative to said support structure to move forwardly from a start position to a predetermined position and to move rearwardly from said predetermined position to said start position;

a discharge nozzle mounted at one end of said lance tube, said discharge nozzle being directed in a direction substantially perpendicular to said longitudinal axis of said lance tube;

a rack disposed in parallel with said lance;

a pinion operable engaged with said rack;

a support plate fixedly secured to said rack and mounted to said lance tube such that said lance tube is rotatable relative to said support plate and axially fixed relative to said support plate;

an elongated shaft rotatably and axially movable supported by said support plate and disposed in parallel with said lance tube;

a differential gear device having an input shaft, a first output shaft connected to said pinion, and a second output shaft connected to said elongated shaft;

a rotary drive source operably connected to said input shaft of said differential gear device;

transmission means for transmitting rotation of said elongated shaft to said lance tube;

restraining means for restraining rotation of said elongated shaft when said lance tube is in an axial position rearwardly of said predetermined position;

prevention means for preventing said lance tube from advancing axially beyond said predetermined position;

feeding means for feeding a discharge medium into said lance tube when said lance tube is present at said predetermined position; and wherein said restraining means comprises a guide mounted to said support structure in parallel with said lance tube, and a moving plate axially slidably and substantially non-rotatably supported by said elongated shaft, said moving plate having a slot formed therein which is engageable with said guide.

2. An extraction/insertion type soot blowing apparatus as recited in claim 6, further comprising a movable piece, mounted to said support structure, which allows said moving plate to rotate in one direction but prevents said moving plate from rotating in the opposite direction.

3. An extraction/insertion type soot blowing apparatus as recited in claim 1, further comprising a dog mounted to said lance tube for rotation therewith; and a stationary limit switch, engageable by said dog, for reversing rotation of said lance tube when engaged by said dog.

4. An extraction/insertion type soot blowing apparatus, comprising a support structure;

a lance tube mounted to said support structure, having a longitudinal axis, and being axially movable relative to said support structure to advance from a start position to a predetermined position and to withdraw from said predetermined position to said start position;

a nozzle mounted at one end of said lance tube, said nozzle being directed in a direction substantially perpendicular to said longitudinal axis of said lance tube;

a rack disposed in parallel with said lance;

a pinion operably engaged with said rack;

a support plate fixedly secured to said rack and mounted to said lance tube such that said lance tube is rotatable relative to said support plate and axially fixed relative to support plate;

an elongated shaft rotatably and axially movably supported by said support plate and disposed in parallel with said lance tube;

a differential gear device having an input shaft, a first output shaft connected to said pinion, and a second output shaft connected to said elongated shaft;

a rotary drive source operably connected to said input shaft of said differential gear device;

transmission means for transmitting rotation of said elongated shaft to said lance tube;

restraining for restraining rotation of said elongated shaft when said lance tube is in an axial position rearwardly of said predetermined position;

prevention means for preventing said lance tube from advancing axially beyond said predetermined position;

feeding means for feeding a discharge medium into said lance tube when said lance tube is present at said predetermined position; and wherein said feeding means comprises an opening/-closing cam fixedly secured to said lance tube and having a notch, a linkage having a cam-follower adapted to engage said notch of said opening/closing cam when said lance tube is present at said predetermined position, and a head valve adapted to be actuated by said linkage to feed the discharge medium to said lance tube.

* * * * *